US011566418B2

(12) United States Patent
Ben Saad et al.

(10) Patent No.: US 11,566,418 B2
(45) Date of Patent: Jan. 31, 2023

(54) BRACING DEVICE FOR SECURING A FACING

(71) Applicants: SAINT-GOBAIN ISOVER, Courbevoie (FR); SAINT-GOBAIN PLACO, Courbevoie (FR)

(72) Inventors: Manel Ben Saad, La Garenne Colombes (FR); Patrice Freslon, Marmande (FR); Jean-Claude Leguay, Camaret-sur-Aigues (FR)

(73) Assignees: SAINT-GOBAIN ISOVER, Courbevoie (FR); SAINT-GOBAIN PLACO, Courbevoie (FR)

( * ) Notice: Subject to any disclaimer, the term of this patent is extended or adjusted under 35 U.S.C. 154(b) by 93 days.

(21) Appl. No.: 17/253,531

(22) PCT Filed: Jun. 19, 2019

(86) PCT No.: PCT/FR2019/051495
§ 371 (c)(1),
(2) Date: Dec. 17, 2020

(87) PCT Pub. No.: WO2019/243738
PCT Pub. Date: Dec. 26, 2019

(65) Prior Publication Data

US 2021/0115662 A1 Apr. 22, 2021

(30) Foreign Application Priority Data

Jun. 19, 2018 (FR) ..... 1855396

(51) Int. Cl.
*E04B 1/76* (2006.01)
*E04F 13/08* (2006.01)

(52) U.S. Cl.
CPC ..... *E04B 1/7629* (2013.01); *E04B 1/7675* (2013.01); *E04F 13/0855* (2013.01)

(58) Field of Classification Search
CPC ..... E04B 1/762; E04B 1/7625; E04B 1/7629; E04B 1/7633; E04B 1/7637; E04B 1/7675; E04F 13/0853; E04F 13/0855
(Continued)

(56) References Cited

U.S. PATENT DOCUMENTS 1,503,148 A * 7/1924 Bernstrom ..... F16B 9/052 52/703
3,019,864 A 2/1962 Lester
(Continued)

FOREIGN PATENT DOCUMENTS

DE 198 22 116 A1 11/1999
EP 0 878 591 A1 11/1998
(Continued)

OTHER PUBLICATIONS

International Search Report as issued in International Patent Application No. PCT/FR2019/051495, dated Nov. 21, 2019.

*Primary Examiner* — William V Gilbert
(74) *Attorney, Agent, or Firm* — Pillsbury Winthrop Shaw Pittman LLP

(57) ABSTRACT

A bracing device for securing at least one facing panel in front of a structure, includes a mounting plate equipped with a bearing face which is planar overall, against which the facing panel can bear, the bearing face having at least one transverse dimension greater than or equal to 30 mm, and a body extending in an axial direction and equipped, at a front end, with a mechanism for securing it to the mounting plate and, at a rear end opposite to the front end, with a mechanism for securing it to the structure.

20 Claims, 9 Drawing Sheets

(58) Field of Classification Search
USPC ..... 52/364, 365, 376
See application file for complete search history.

(56) References Cited

U.S. PATENT DOCUMENTS

| | | | | |
|---|---|---|---|---|
| 3,889,439 | A * | 6/1975 | Kaspar | E04F 13/0808 403/107 |
| 4,040,222 | A | 8/1977 | Cull | |
| 5,809,725 | A * | 9/1998 | Cretti | E04F 13/045 52/565 |
| 6,234,736 | B1 * | 5/2001 | Miescher | F16B 13/00 411/908 |
| 7,934,693 | B2 * | 5/2011 | Bravinski | E04G 11/18 249/40 |

FOREIGN PATENT DOCUMENTS

| | | | |
|---|---|---|---|
| EP | 2 712 977 | A1 | 4/2014 |
| EP | 2 754 770 | A1 | 7/2014 |
| EP | 3 190 242 | A1 | 7/2017 |
| WO | WO 2006/061538 | A1 | 6/2006 |

* cited by examiner

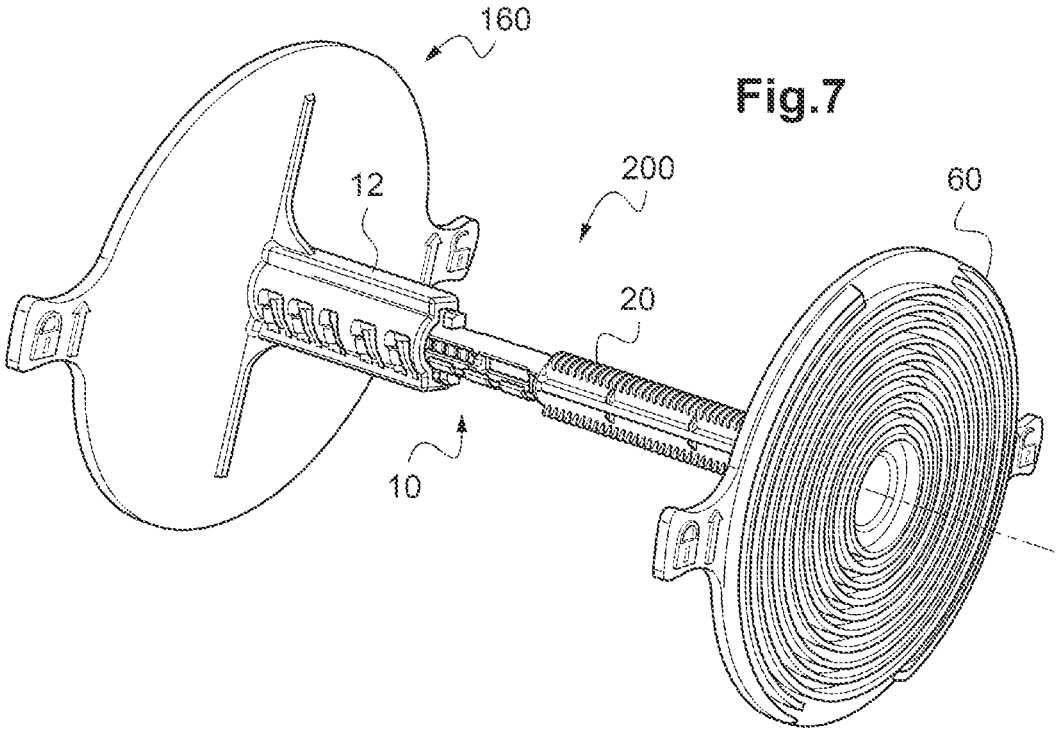
Fig.7
Fig.8A
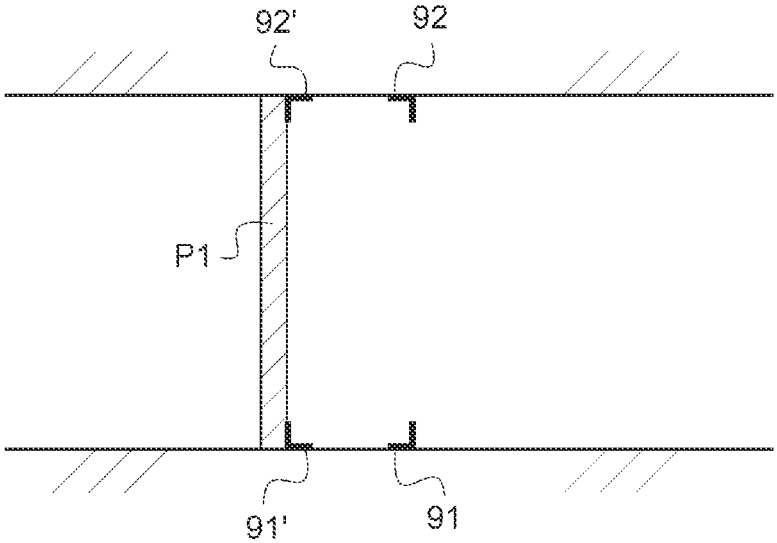

BRACING DEVICE FOR SECURING A FACING

CROSS-REFERENCE TO RELATED APPLICATIONS

This application is the U.S. National Stage of PCT/FR2019/051495, filed Jun. 19, 2019, which in turn claims priority to French patent application number 1855396 filed Jun. 19, 2018. The content of these applications are incorporated herein by reference in their entireties.

TECHNICAL FIELD

The present description relates to a bracing device for securing at least one facing panel in front of a structure, in particular when lining a structure, for example lining a wall, a partition, a ceiling, a sloping structure, or when creating a dividing partition.

BACKGROUND OF THE INVENTION

A structure such as a wall, a ceiling, etc. is often lined during renovations or new-build in order to obtain or improve the thermal insulation of the building.

A facing panel is then, in this context, attached to a framework which is itself secured to the dividing structure that is to be lined, at a given distance away from same, using evenly spaced bracing or spacing accessories.

The framework is made up of metal profile sections, also referred to as furring, typically of C-section, placed vertically between and fitted into two horizontal profile sections also referred to as the top rail and the bottom rail.

Each bracing accessory typically comprises a main body in the form of a shank extending transversely to the dividing structure that is to be lined and to the facing, and one end of which is provided with means for securing it cantilever-fashion to the dividing structure that is to be lined and the other end of which bears means for assembling it with the metal lining framework. These assembly means typically comprise a slot into which the edges of the metal profile sections can engage in the manner of a clip. Such a bracing accessory is known for example from document WO2006/061538. A finishing element in the form of a facing panel, for example a sheet of plasterboard, a sheet of cement board, of wood, an OSB, etc. will then be secured to the framework.

In the same way, a dividing partition is generally formed of two facings secured one on each side of a framework comprising a plurality of metal members, generally equidistant, placed vertically between and fitted into two horizontal members, also referred to as the top rail and the bottom rail, fixed respectively to the ceiling and to the floor.

The installation of such metal frameworks imposes numerous constraints: profile sections of specific cross section, which are long and bulky, need to be delivered to the site in great numbers. Cutting these metallic elements to length to suit the height of the dividing structure also poses problems with safety. Finally, fitting the framework takes a great deal of time, because of the numerous steps it involves: fitting the top and bottom rails, fitting each vertical profile section, adjusting the verticality and flatness of the framework.

OBJECT AND SUMMARY OF THE INVENTION

One of the objectives of the present invention is to simplify the securing of at least one facing panel in front of a structure, in particular when lining a structure, for example a wall, a partition, a ceiling, a sloping structure, or when creating a dividing partition, by proposing a device that limits the number of elements and operations required.

This objective is achieved with a bracing device for securing at least one facing panel in front of a structure, comprising

- a mounting plate equipped with a bearing face which is planar overall, against which the facing panel can bear, said bearing face having at least one transverse dimension greater than or equal to 30 mm, preferably greater than or equal to 45 mm, and
- a body extending in an axial direction and equipped, at a front end, with means for securing it to the mounting plate and, at a rear end opposite to the front end, with means for securing it to the structure.

The structure in front of which the bracing device can be used may be any structure that is to be lined, for example a wall, a partition, a ceiling, a sloping structure (when creating a lining partition). It may also be made up of one or more panel(s) intended to form a first facing of a dividing partition (the device then forming a bracing spacer between the first and second facing of the partition).

What is therefore meant here by "facing panel" is any sheet intended to form a decorative or dividing structure in front of an existing dividing structure or construction.

The mounting plate of the bracing device according to the invention is equipped with a bearing face that is planar overall and against which the facing panel can bear and be secured firmly enough to ensure the assembly good mechanical integrity. What is meant here by planar overall is that the high points of this face are all situated in substantially the one same plane or, more generally, that its envelope surface is substantially planar. Giving the bearing face of the mounting plate a sufficient transverse dimension makes such securing possible and also contributes to the mechanical stiffness of the lining.

As will be described in greater detail later, the facing panel can be secured to the mounting plate by bonding and/or the mounting plate can be configured to be pierced by one or more fixing screws when the panel is secured by screwing.

Lining using a bracing device according to the invention thus involves fitting the bracing devices and/or the lining panel(s) on the bracing device or devices but, contrary to the requirements of the methods of the prior art, does not entail fitting additional metal profile sections on the bracing devices before the facing panels are secured. It can therefore be done quickly, with the minimum of successive steps.

Furthermore, site management becomes easier in that the lining involves a limited number of components and those components are not very bulky.

Similar advantages are had in creating a dividing partition using a bracing device according to the invention, where once again, the vertical metal profile sections can be omitted.

When the bracing device is in its mounted position, the bearing face of the mounting plate is defined in a plane substantially orthogonal to the axial direction of the bracing device.

According to one example, the minimum transverse dimension of the mounting plate is greater than or equal to 30 mm, preferably greater than or equal to 45 mm. What is meant by the minimum transverse dimension of the mounting plate is the smallest dimension of the mounting plate measured in a plane orthogonal to the axial direction, when the mounting plate is secured to the front end of the body.

The maximum transverse dimension of the mounting plate is preferably less than or equal to 600 mm, in particular less than or equal to 400 mm and even less than or equal to 200 mm.

The mounting plate may for example have an axial cross section that is circular overall. As an alternative, it may also be square, rectangular, hexagonal or octagonal or have any other suitable shape.

According to one advantageous arrangement, the mounting plate may be equipped with means for grasping—for example grasping lugs—at its periphery, making it easier to grasp and to mount on the body.

According to one example, the body at its front end comprises a shank extending in the axial direction, and the mounting plate is designed to be engaged on said shank via a mounting opening formed in said mounting plate.

As a preference, the body is configured, at its front end, to receive insulation and/or a membrane speared onto it. When, as indicated hereinabove, the body comprises a shank, this shank may advantageously have a tapering end, preferably pointed.

In that case, the bracing device may comprise a mechanism for finely adjusting the position of the mounting plate on the shank, in the axial direction.

According to one example, the means for securing the mounting plate to the shank comprise primary ribs formed at the periphery of a portion of said shank and the mounting plate has at least one secondary rib projecting toward the inside of the mounting opening, the secondary rib being designed to collaborate with primary ribs for blocking said mounting plate on the shank in terms of translation movement in the axial direction.

The primary ribs formed at the periphery of the portion of shank may form a screw thread or may be distinct from one another and mutually parallel.

In the latter instance, they may be perpendicular to the axial direction, or make an angle other than 90° with said direction.

For example, the primary ribs may be spaced at intervals with a fine pitch p, in particular comprised between 0.1 and 5 mm, in particular between 0.2 and 2 mm, and more particularly between 0.5 and 1.5 mm.

According to one arrangement, the mounting plate may be mounted on the shank of the body by a system of the bayonet or quarter-turn type.

In that case, the primary ribs of the portion of shank may be truncated over at least a truncated primary angular portion, and the at least one secondary rib may be truncated over at least one truncated secondary angular portion.

The mounting plate is therefore engaged by aligning the non-truncated secondary angular portion with the truncated primary angular portion then pivoting the mounting plate and the portion of shank the one relative to the other so as to bring the secondary rib into engagement with the primary ribs, thus blocking axial movement of the mounting plate.

Advantageously, at least one of the secondary ribs is equipped with an end-of-travel end stop configured to block the rotation of the mounting plate with respect to the portion of shank in one direction of rotation about the axis, by collaborating with a lateral edge of a primary rib or of two parallel adjacent primary ribs.

Advantageously, in order to increase its rigidity, the mounting plate is equipped with reinforcing means, in particular with stiffeners, on its opposite side to the bearing face.

As a preference, the bearing face is provided with catching means able to collaborate with means for securing of the facing panel.

According to one example, the bearing face is textured. What is meant by a "textured face" is that the face in question exhibits a relief, made up of a succession of peaks and valleys. This relief may be periodic or random. The texturing of the surface may also exhibit a plurality of different reliefs, distributed uniformly or randomly. By way of example, the bearing face may be provided with concentric and/or honeycomb ribs and/or grooves, or else an assembly of concentric ribs and radial grooves.

The texturing of the bearing face allows better catching of the screws for securing of the facing panel or, in the case of securing using adhesive, increases the area of contact of the adhesive with the mounting plate.

Advantageously, the mounting plate comprises means for connection to a profile section, in particular means for clipped slideway connection of the mounting plate to a profile section, in particular at least one slot designed to accept reentrant edges of the profile section in the manner of a clip. The bracing device according to the invention can thus be used in combination with a profile section, for example for locally strengthening the lining at certain special points (around windows for example).

The mounting plate may be designed to be secured to the body reversibly. In other words, the mounting plate may just as well be mounted on the body in such a way that its bearing face faces toward the front or toward the rear. The means for clipped slideway connection are provided on the rear face of the mounting plate.

According to one advantageous arrangement, the body comprises

- a shank extending in the axial direction, at its front end,
- a securing base bearing the means for securing to the structure, and
- a mechanism for adjusting the length of the body by intervals through relative sliding of the securing base and of the shank.

According to one example, the adjusting mechanism is considered in such a way that the securing base and the shank are designed to slide one relative to the other in the axial direction in a first relative angular position, and the securing base and the shank are designed to pivot into a second relative angular position in which they are blocked from axial translation in a plurality of positions of adjustment spaced at intervals in the axial direction.

Thanks to the mechanism for adjusting the length of the body, the operator can use the one same bracing device for different thicknesses of (lining or dividing) partition.

According to one example, the securing base and the shank are designed to pivot into a second relative angular position in which they are blocked from axial translation only in a plurality of positions of adjustment which are spaced at intervals in the axial direction at a coarse pitch P comprised between 0.5 and 5 cm, preferably between 0.5 and 2 cm, and more preferably still, between 0.8 and 1.3 cm. Because the adjustment mechanism is spaced at intervals at a coarse pitch, adjustment can be performed quickly. The operator can choose between only the various positions of adjustment, which are evenly spaced. A simple calculation allows him to adjust the device to the desired length.

According to one example, the bracing device further comprises means for blocking the rotation of the securing base and of the shank, in the second angular position.

According to one example, the blocking means comprise clipping means.

According to one example, the securing base comprises an adjusting part designed to accept the shank and equipped with a plurality of notches, in particular of notches spaced axially by the coarse pitch P, and the shank comprises lugs formed at its periphery and designed to engage with said notches.

According to one example, the clipping means comprise a clipping tongue delimiting a notch of the adjusting part and referred to as the blocking notch, which tongue is designed to move in collaboration with a lug of the shank upon a rotation from the first to the second angular position and to prevent the return of the lug once the second angular position has been reached.

As a preference, the device comprises means allowing return to the first angular position under the effect of a relative rotational movement of the shank and of the securing base, or the combined effect of a relative translational and rotational movement of the shank and of the securing base.

According to one example, the shank has at least one axial groove and the adjusting part has at least one internal additional thickness situated in the vicinity of its front end and designed to slide in said groove when the shank and the adjusting part are in the first angular position. These arrangements allow the operator easily to identify the first angular position, in which the length of the body can be adjusted by relative sliding of the shank and of the securing base.

According to one advantageous example, the shank further exhibits a plurality of circumferential grooves extending from the axial groove and parallel to one another, the internal additional thickness of the adjusting part being designed to enter one of said circumferential grooves during the transition from the first to the second angular position. These arrangements allow the operator more easily to access the positions of adjustment of the device.

According to one example, the means for securing to the structure comprise a plate equipped with screw holes.

According to one example, the means for securing to the structure comprise means for connection to a profile section, in particular means for clipped slideway connection, in particular at least one slot designed to accept reentrant edges of the profile section in the manner of a clip.

According to another example, the means for securing it to the structure comprise a second mounting plate equipped with a bearing face that is planar overall, having at least one transverse dimension greater than or equal to 30 mm, preferably greater than or equal to 45 mm. It will be appreciated that the respective bearing faces of the first and of the second mounting plates then face in opposite directions. The second mounting plate may be secured to the structure by bonding, and/or the second mounting plate may be configured to be pierced with one or more screws for securing using screw fastening.

The present description also relates to an assembly, in particular a lining of a structure (particularly a wall, a ceiling, a sloping structure) or a dividing partition, comprising

- at least one bracing device as defined hereinabove
- at least one facing panel, bearing directly against the bearing face of the mounting plate of the bracing device and secured to said mounting plate.

If the assembly is a lining of a structure, then the lining is in particular an interior lining, or in other words a lining wherein a facing panel is fitted in front of a structure of a construction, on the interior of said construction.

The facing panel, bearing directly on the mounting plate, may for example be secured to said mounting plate using screws, or else by bonding means, in particular an adhesive or an adhesive element of the film or tape type, or else by a combination of screw-fastening and bonding means.

What is meant by "bears directly" is therefore that it bears directly or via a thin coat of adhesive or a thin adhesive element.

The facing panel may be a sheet of plasterboard, which may or may not be provided with a decorative covering, either monolithic or with a sandwich or laminate structure made up of several sheets bonded together.

The facing panel may also be a sheet of cement board, of wood, of wood composite (particleboard, OSB). It may also be made from a plastic or metallic material, or from any other suitable material.

The material of which it is made (plasterboard, plastic, etc.) may potentially be reinforced with fibers (mineral fibers, cellulose fibers, etc.).

The facing panel advantageously has a bending modulus greater than or equal to 3 GPa, preferably less than or equal to 10 GPa, preferably comprised between 3 and 10 GPa, even more preferably comprised between 4 and 8 GPa, and even more preferably still, between 4 and 6.5 GPa. In this way it is possible to reduce the number of bracing devices required, and therefore the fitting time.

As a preference, the assembly, in particular a lining of a structure or dividing partition, comprises on average between 1 and 2 bracing devices per square meter. Away from the special points (doors, windows, etc.), the mean number of bracing devices per square meter is preferably between 0.5 and 1.5, in particular equal to 1.

The bending modulus is obtained using a 3-point bending test in accordance with section 5.7 of standard NF-EN 520: a test specimen is cut to the dimensions 400 mm×300 mm×12.5 mm. The test specimen is placed on two parallel cylindrical supports having a radius comprised between 3 mm and 15 mm, their centers being spaced by (350±1) mm. The test specimen is subjected to a constant force of (250±125) N/min at the center ±2 mm of the span. The force and the displacement are measured. The applied force (N) is plotted against the displacement (m), to give the stress/deformation curve.

The bending modulus ($E_{bend}$) is then obtained using the formula $$E_{bend} = \frac{L^3 F}{4wh^3 d}$$

Where

L=distance between supports (0.350 m)

F=applied force in newtons (N)

w=width of test specimen (0.300 m)

h=thickness of test specimen (0.0125 m)

d=displacement (m)

F/d=gradient of the stress/deformation curve in the elastic domain

According to one example, at least one layer of thermal and/or acoustic insulation is speared onto or interposed between the bracing devices.

The present description finally relates to a method for securing at least one facing panel on the front of a structure, comprising at least the following steps, in this order:

- a plurality of bracing devices as defined hereinabove is supplied,
- the bodies of the bracing devices are secured to the structure, via their rear ends, the mounting plates are secured on the bodies of the bracing devices, at their front ends, at least one facing panel is mounted bearing directly against at least one mounting plate, and the facing panel is secured to said at least one mounting plate.

The facing panel may for example be secured to the mounting plate by screw fastening or by bonding, in particular using a liquid or pasty adhesive, for example a mastic, applied to the bearing face of the mounting plate before the facing panel is fitted, or by means of an adhesive element, of the film or tape type, in particular a double-sided sticky tape.

A number of embodiments or examples are described in the present description. However, unless specified otherwise, the features described in connection with any one embodiment or example can be applied to another embodiment or example.

BRIEF DESCRIPTION OF THE DRAWINGS

The invention will be better understood and its advantages will become better apparent, from reading the following detailed description of a number of embodiments which are given by way of nonlimiting examples. The description refers to the attached drawings in which:

FIG. 7 illustrates a bracing device according to a second embodiment of the invention, in which the means for securing the body to the structure comprise a second mounting plate;

FIGS. 8A to 8D illustrate the successive steps of a second way of implementing the method of the invention (to create a dividing partition);

DETAILED DESCRIPTION OF EMBODIMENT EXAMPLES

A bracing device 100 according to the invention is intended to be used to secure a facing panel to the front of a structure, in particular for lining in front of a wall.

Figure 6A:
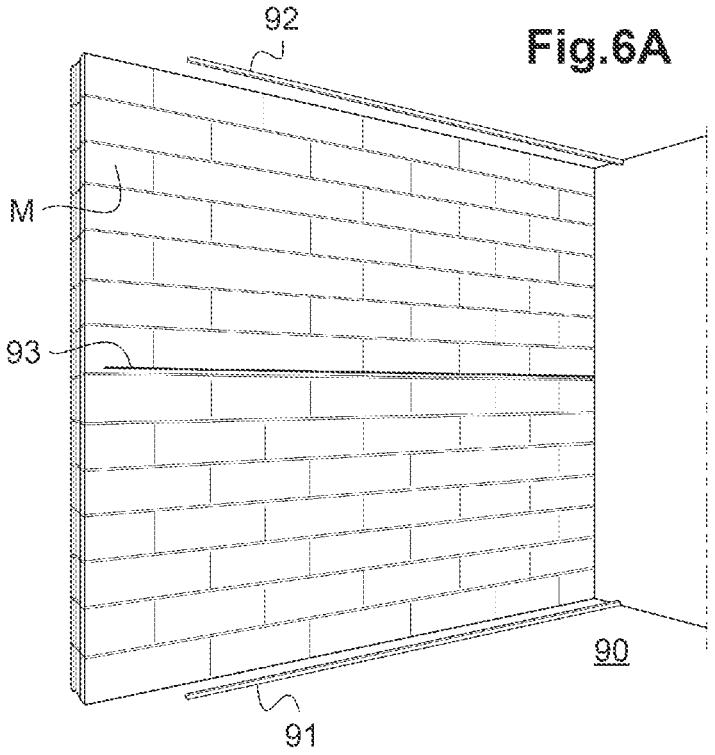
FIGS. 6A to 6F illustrate the successive steps of a first way of implementing the method of the invention (to produce a lining partition in front of a wall M)
Figure 6B:
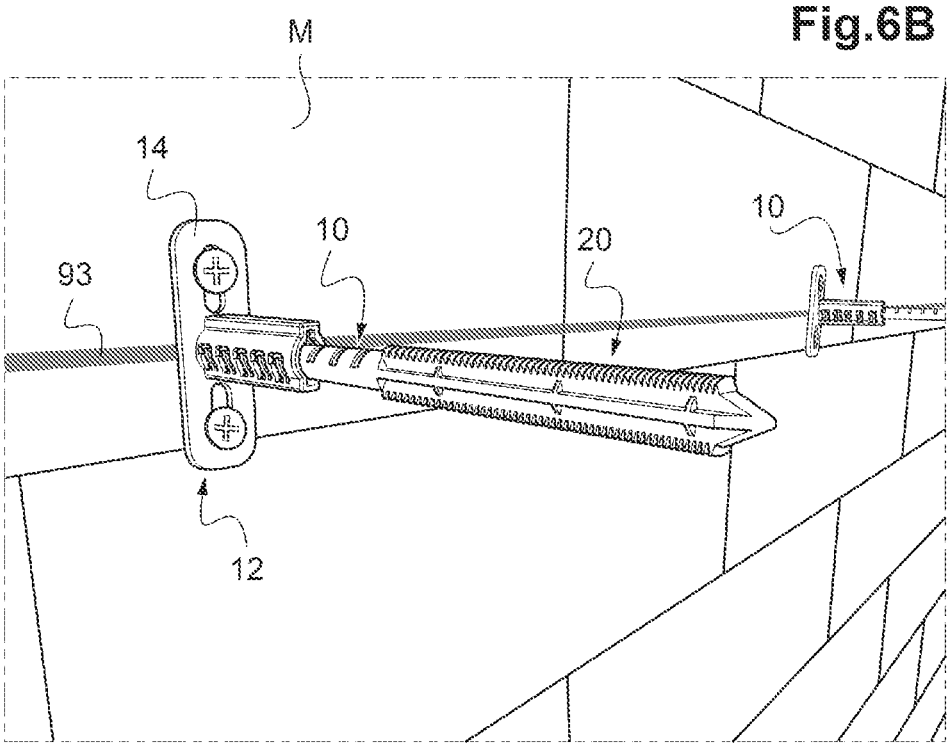
Figure 6C:
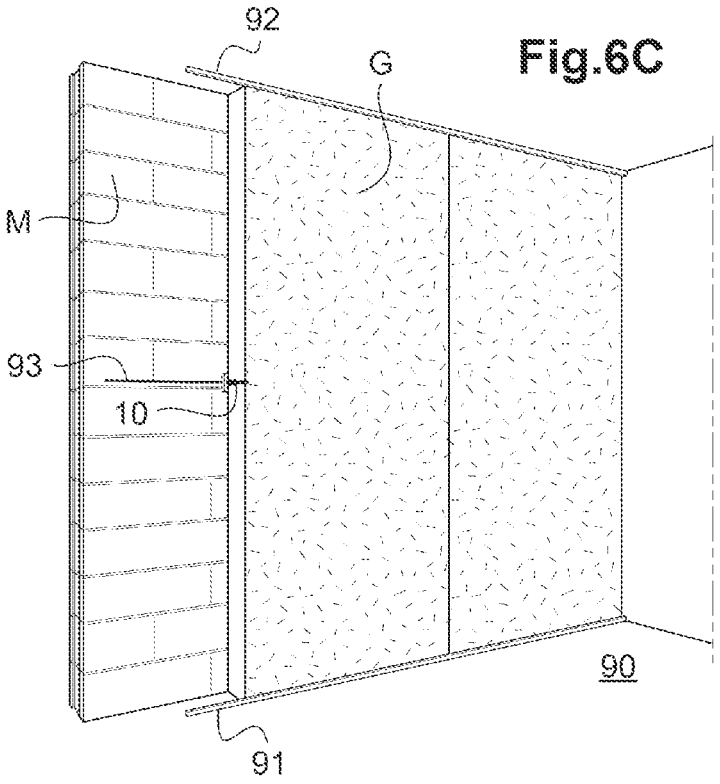
Figure 6D:
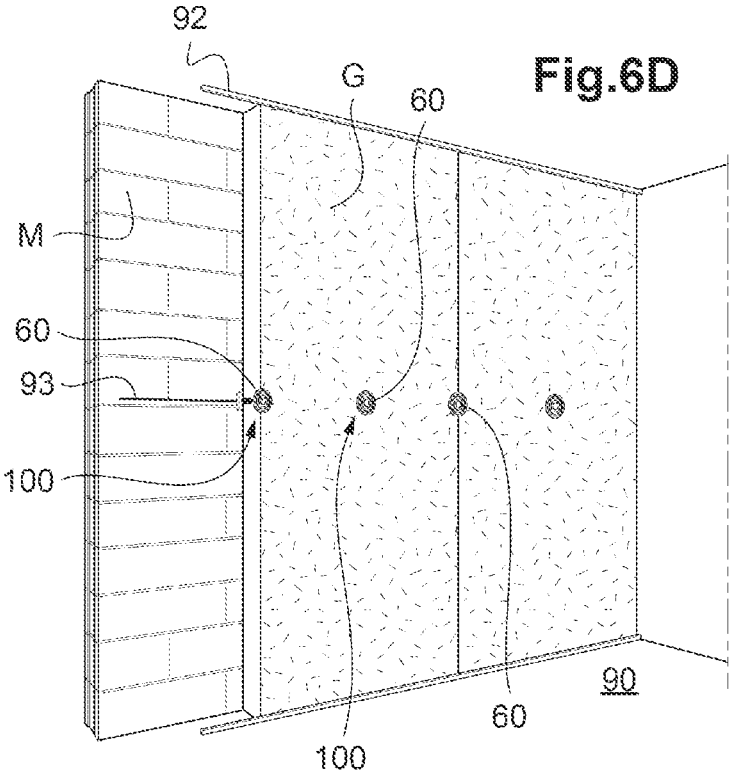
Figure 6E:
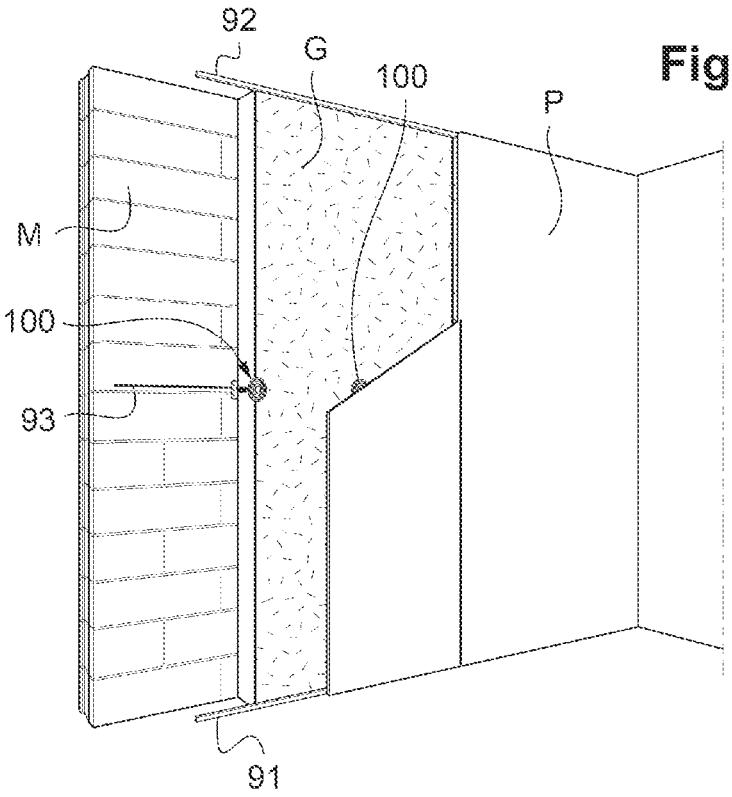

According to one nonlimiting embodiment illustrated in FIG. 6E, a plurality of bracing devices 100 is secured to a wall M that is to be lined, an insulating filling G is speared onto or interposed between the bracing devices, and facing panels P are secured to the front of said bracing devices, covering the insulating filling.

A bracing device 100 according to one embodiment of the invention is illustrated in FIGS. 1 to 5.

At the very least, it is made up of a main body 10 designed to be secured to the wall M or to some other structure, and of a mounting plate 60 designed to be mounted at the front end 10*a* of the body 10 and intended to have a facing panel P bearing against it.

The body 10 and the mounting plate 60 are made for example from a polymer material, which may or may not be reinforced, for example with a glass fiber reinforced polyamide (the reinforcement representing for example between 20 and 40% by mass) or from polypropylene.

Throughout the present description, the rear of a component will be referred to as its side closest to the structure, and the front of the same component as its side closest to the facing panel or panels P, in the assembled position.

In the example illustrated, the body 10 comprises:

at its rear end 10*b*: a base 12 for securing to the wall M and equipped with means for securing the body 10 to the structure M that is to be lined at its front end 10*a*: a shank 20 to which the mounting plate 60 is secured.

The means for securing the body 10 to the structure M that is to be lined here comprise a securing plate 14 provided with holes 16 for securing it using screws.

Advantageously, the securing plate 14 has at least one oblong hole 16*a*, 16*b* allowing fine adjustment of the positioning of the securing base 12 on the wall M. In the example depicted in FIGS. 1 and 2, the securing plate comprises two oblong holes 16*a*, 16*b*, the longest dimensions of which are parallel to one another. Alternatively, the longest dimensions of the oblong holes may be perpendicular to one another in order to facilitate fine adjustment of the positioning of the base both vertically and horizontally.

Advantageously, the securing plate 16 is also provided with slots 18*a*, 18*b* designed to collaborate by clip fastening with a profile section secured beforehand to the structure that is to be lined, and in particular designed to accept reentrant edges of said profile section. What is meant by a profile section is, in general, a metal profile section, preferably a C-section, applied to the structure that is to be lined with the back of the C facing toward the structure that is to be lined and the opening of the C facing toward the lining to be applied.

The illustrated example of the securing plate 14 is not, however, limiting, and the means for securing the body 10 to the structure may adopt other forms, for example suited to being secured using nails.

Figure 4:
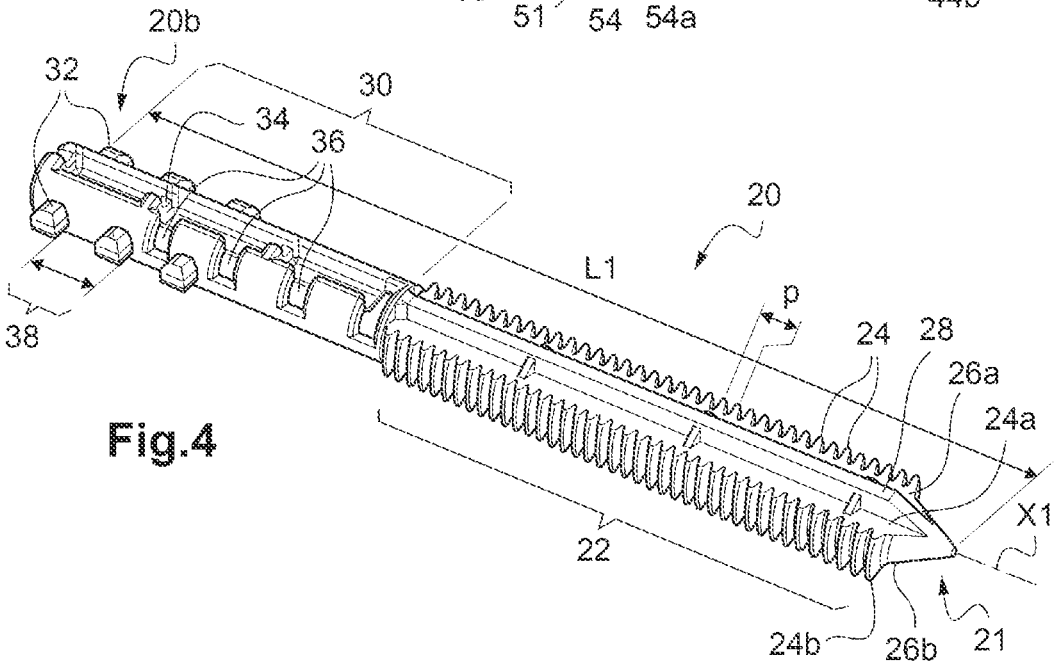
FIG. 4 shows the shank in greater detail.

The shank 20 of the body, which shank is illustrated in greater detail in FIG. 4, extends along an axis X1 defining an axial direction of the bracing device 100.

In an advantageous arrangement, it is configured to be able to pierce the insulating filling G or, where applicable, a damp-proof membrane attached in front of said insulating filling G, and for that purpose may have a tapering, preferably pointed tip 21.

The shank 20 is also provided with means for securing to the mounting plate 60.

In the example at its periphery it comprises, over at least a portion 22 situated at its front end, a plurality of ribs 24 referred to as primary ribs, in this instance uniformly spaced from one another, mutually parallel and orthogonal to the axial direction X.

For example, the primary ribs 24 may be spaced at intervals with a fine pitch p, in particular comprised between 0.1 and 5 mm, in particular between 0.2 and 2 mm, and more particularly between 0.5 and 1.5 mm.

Each rib 24 in this instance is truncated over two angular portions (referred to as truncated primary portions) 26*a*, 26*b* and is thus formed of two rib portions (referred to as non-truncated primary portions) 24*a*, 24*b*, of an angle of less than 90°, which are diametrically opposed.

Stiffening ribs 28 may advantageously be provided to strengthen the shank 20 at each truncated primary angular portion.

The mounting plate 60 will now be described in greater detail with reference to FIGS. 1, 2 and 5.

Hereinafter, a central axis (in this instance an axis of symmetry) X2 of the mounting plate 60 is defined. In a direction parallel to this axis X2, the mounting plate 60 is delimited by a bearing face 62 intended to have the facing panel or panels P bearing against it, and by an opposite face 64 substantially parallel to said bearing face.

In the standard setup (illustrated in FIGS. 1 and 2) the bearing face 62 of the mounting plate 60 is situated toward the front of the bracing device. The bearing face 62 is therefore considered as being the front face of the mounting plate 60, and the opposite face 64 as being its rear face.

Once the mounting plate 60 is mounted on the shank 20, in the standard setup just as in the reverse setup, the axis X2 is coincident with the axis X1 corresponding to the axial direction X of the bracing device 100. Throughout the present description, an axial direction mentioned in connection with the mounting plate corresponds to the direction of the axis X2 and therefore to the axial direction X of the bracing device in the mounted position. A radial direction is orthogonal to this axial direction.

In order to engage it on the shank 20 of the body 10, the mounting plate 60 has a central mounting opening 70, centered on the axis X2.

In the example, this central mounting opening 70 is extended, beyond the rear face 64 of the mounting plate 60, by a cylindrical sleeve 72.

Figure 5:
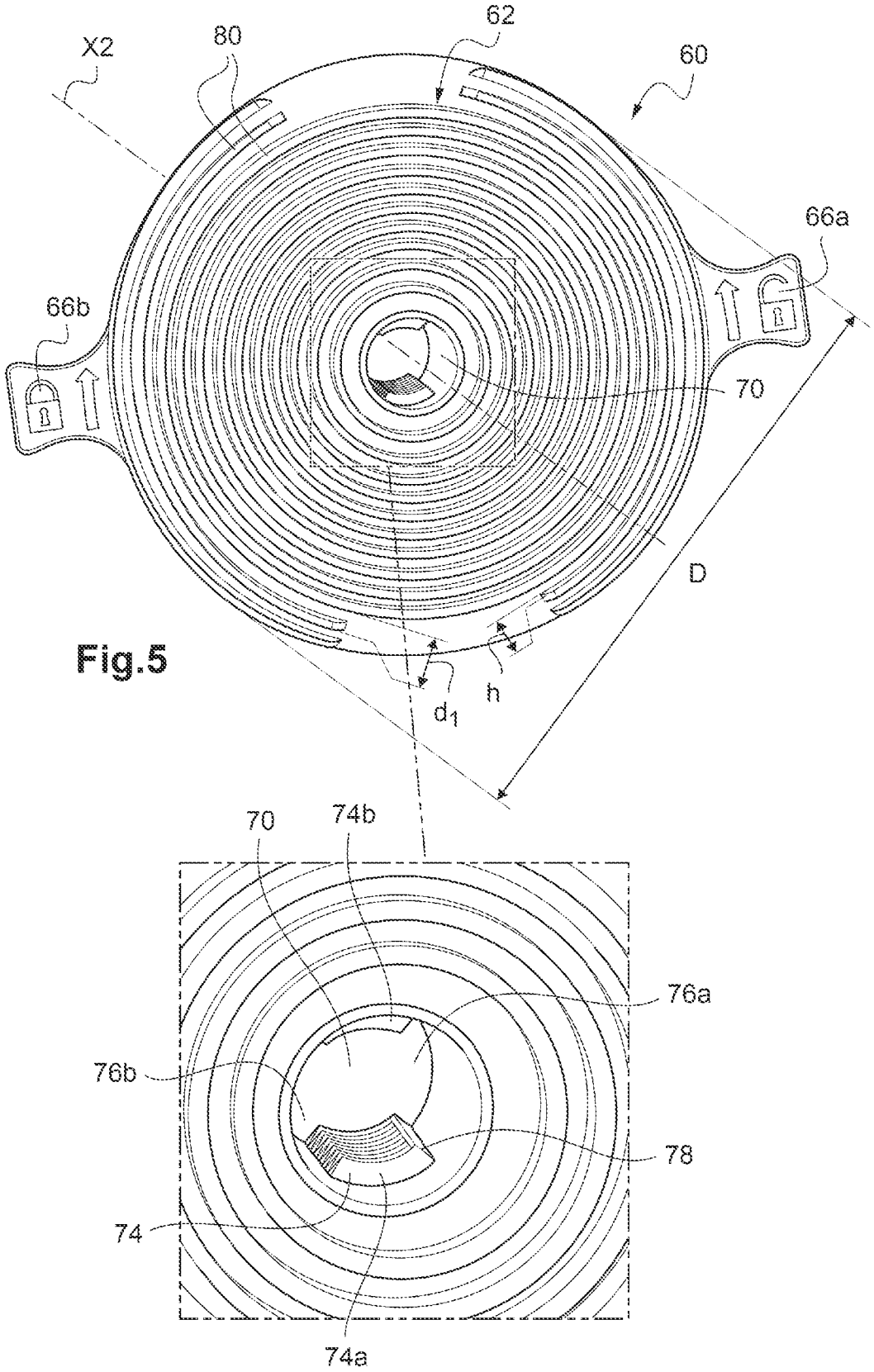
FIG. 5 is a front view of the mounting plate.

In the detail shown in FIG. 5, it may be seen that several ribs 74, referred to as secondary ribs, project toward the inside of the mounting opening 70.

These secondary ribs 74 are designed to collaborate with the primary ribs 24 of the shank 20 in order to block translational movement of the mounting plate 60 on the body 10 in the axial direction X.

They are spaced uniformly from one another, are mutually parallel, and are orthogonal to the axis X2.

The mounting plate 60 is mounted on the shank 20 via a system of the bayonet or quarter-turn type:

For that, the secondary ribs 74 are truncated over two angular portions (referred to as truncated secondary portions) 76*a*, 76*b*, each secondary rib thus being formed of two non-truncated secondary angular portions 74*a*, 74*b*.

The mounting plate 60 is engaged on the shank 20 by aligning the non-truncated secondary angular portions 74*a*, 74*b* with the truncated primary angular portions 26*a*, 26*b*, then by causing relative pivoting of the mounting plate 60 and the portion of shank 22 so as to bring the secondary ribs 74 into engagement with the primary ribs and thus block the axial movement of the mounting plate.

Advantageously, the secondary ribs 74 are equipped with an end-of-travel limit stop 78 configured to block the rotation of the mounting plate 60 with respect to the portion of shank 22 in one direction of rotation about the axis X, by collaborating with a lateral edge of a primary rib 24 or with two parallel adjacent primary ribs 24.

However, the abovementioned example is nonlimiting and the means for securing the mounting plate 60 on the body 10 may adopt any other suitable form that may or may not allow adjustment of the axial positioning of the mounting plate 60 on the body 10. Such means could, for example, be clip-fastening means, or else a continuous screw thread for mounting by screwing without blocking.

The specific features of the mounting plate 60 that allow the sheet or sheets of facing to be secured firmly to its bearing face will now be described in greater detail.

In an essential arrangement, the bearing face 62 of the mounting plate has at least one transverse dimension greater than or equal to 30 mm, preferably greater than or equal to 45 mm. What is meant by a transverse dimension is a dimension measured in a plane orthogonal to the axis X2 (or in other words to the axial direction X when the mounting plate 60 is secured to the front end 10*a* of the body 10). Giving the bearing face 62 of the mounting plate 60 a sufficient transverse dimension allows the facing panel P to be secured to said mounting plate 60 firmly enough to ensure good mechanical integrity of the assembly.

A minimum transverse dimension of the mounting plate 60 is preferably greater than or equal to 30 mm, preferably greater than or equal to 45 mm. The maximum transverse dimension of the mounting plate 60 is preferably less than or equal to 600 mm, in particular less than or equal to 400 mm, and even less than or equal to 200 mm.

In addition, the total surface area of the bearing face 62 is preferably greater than at least 900 $mm^2$, preferably greater than 2025 $mm^2$. What is meant here by the total surface area is the surface area of the envelope surface of the bearing face 62.

In the example illustrated, the mounting plate 60 has an axial cross section that is circular overall, with a diameter D equal to 9 cm.

By way of alternative, it could obviously be square, rectangular, hexagonal or octagonal or have any other suitable shape.

It is advantageously equipped, at its periphery, with means for grasping making it easier to grasp and to mount on the body 10. These means for grasping may for example comprise grasping lugs 66*a*, 66*b* uniformly distributed on its circumference, preferably at least two diametrically opposed lugs.

The bearing face 62 of the mounting plate 60 may be smooth or, according to an advantageous arrangement illustrated in FIG. 5, may be textured. What is meant by a "textured face" is that the face in question has a relief made up of a succession of peaks and of valleys. This relief may be periodic or random. The texturing of the surface may also exhibit a plurality of different reliefs, distributed uniformly or randomly.

In any case, whether it is smooth or textured, the bearing face 62 remains planar overall. What is meant by a face that is "planar overall" is that the envelope surface of this face is substantially planar.

In the example illustrated, the front face 62 of the mounting plate 60 has a plurality of continuous concentric ribs 80 centered on the axis X2. These ribs 80 all have the same, constant, height h, measured in the direction X2, typically comprised between 1 and 3 mm. The distance dl between two ribs 80, measured in a radial direction, is also comprised between 2 and 5 mm.

The example illustrated is obviously nonlimiting: the ribs 80 could be discontinuous. They could form a different pattern, a honeycomb for example, or else a random pattern.

The ribs 80 form catching means intended to engage with the means for securing of the facing panel.

The texturing effectively gives any fixing screws of the facing panel P a better purchase or, in the case of securing by means of adhesive, increases the area of contact of the adhesive with the mounting plate 60.

Figure 9:
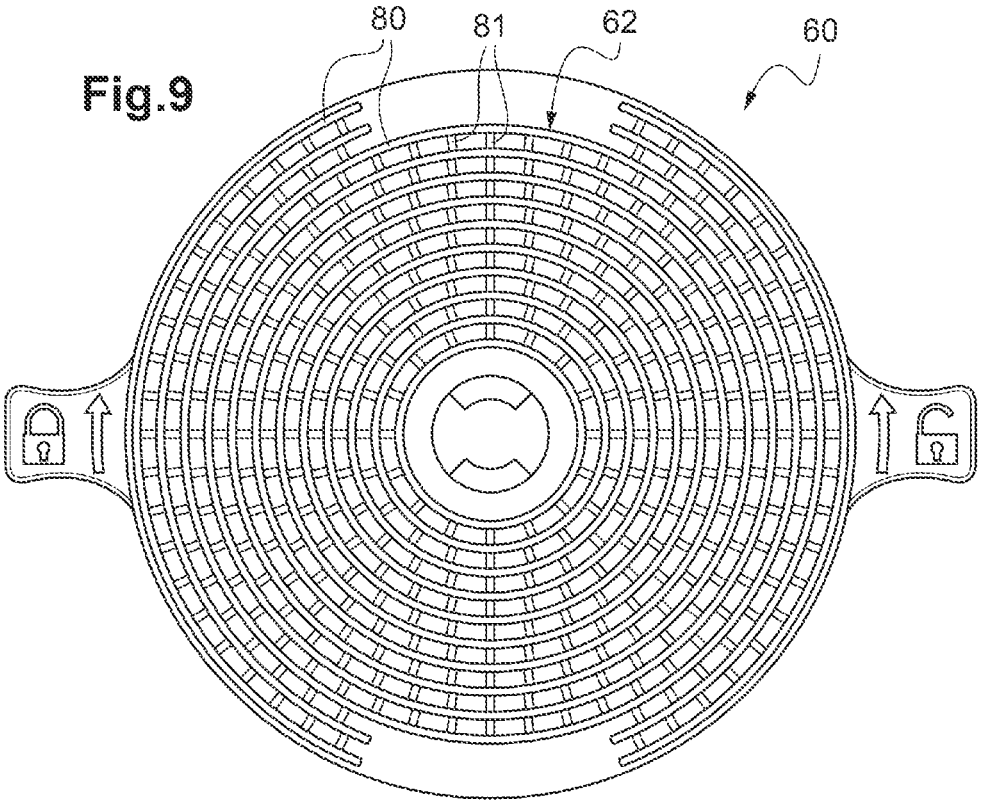
FIG. 9 is a front view of the mounting plate, according to a variant of the invention.

In a variant illustrated in FIG. 9, the front face 62 of the mounting plate 60 exhibits, in addition to the concentric ribs 80, radial ribs 81. These radial ribs 81, positioned between the concentric ribs 80, all have the same, constant, height h1 which is less than the height h of the concentric ribs 80. Such a configuration prevents the screw from causing the mounting plate to spin as the facing panel P is being screwed on, or prevents the screw from screwing in crooked.

At certain special points, in particular around the windows or the doors, it is sometimes preferable to have a continuous support for the facing panels P in the form of metal profile sections as used in the systems of the prior art.

In preparation for such a requirement, the mounting plate 60 may advantageously perform a dual function: on the one hand having facing panels P resting against it and, on the other hand, of supporting a framework element such as a metal profile section.

To do that, in the example, the mounting plate 60 is designed to be secured to the body 10 reversibly and, on its opposite side to the bearing face 62, comprises means for connection to a profile section, in particular means for clipped slideway connection of the mounting plate to a profile section.

The reversibility is made possible here through the fact that the primary ribs 24 and secondary ribs 74 are orthogonal to the axial direction X and can thus collaborate identically whether the mounting plate 60 is mounted in the standard setup or in the reverse setup (with the front face oriented toward the rear of the bracing device 100).

In the example, the means for clipped slideway connection comprise two slots 82*a*, 82*b* designed to accept reentrant edges of the profile section in the manner of a clip.

Figure 2:
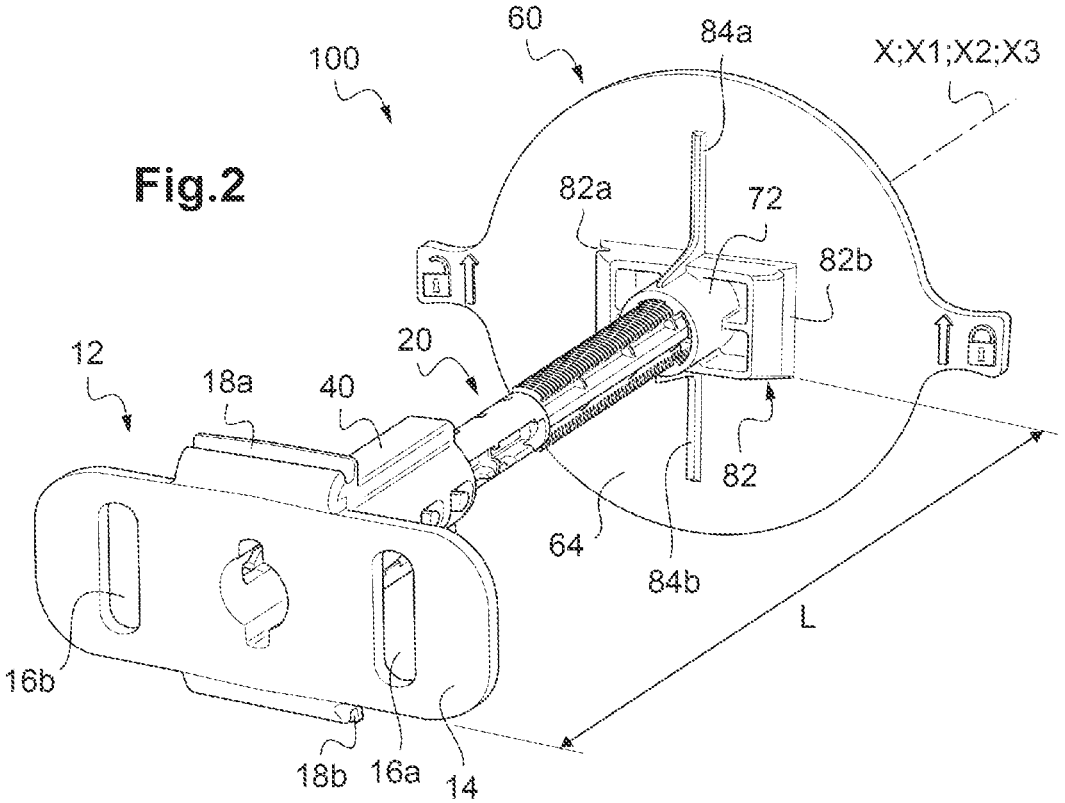
FIG. 2 is a rear view of the device of FIG. 1.

As illustrated in FIG. 2, the mounting plate 60 may advantageously be reinforced, on its opposite side to the bearing face 62, by stiffeners 84*a*, 84*b* which connect the rear face 64 to the cylindrical sleeve 72.

The collaboration of the primary ribs 24 and secondary ribs 74 allows fine adjustment of the position of the mounting plate 60 in the axial direction. This fine adjustment makes it possible for example to compensate for certain irregularities in the surface of the structure M.

In some cases, for example in renovation applications, these irregularities are far greater. In that case, it is advantageous for the bracing device to be provided with a mechanism for adjusting the length of the body 10 by intervals, in particular by relative sliding of the securing base 12 and of the shank 20.

The shank 20 typically has a total length L1 comprised between 5 and 20 cm.

For example, the length L of the body 10 may, by virtue of the adjusting mechanism, be comprised between 5 and 25 cm.

The length is adjusted by relative sliding of the securing base 12 and of the shank 20 in the axial direction X, followed by the blocking of axial translation by relative rotation of the two components 12, 20.

In the example, translational movement is blocked in one of several possible positions of adjustment, spaced at intervals at a coarse pitch P comprised for example between 0.5 and 5 cm, preferably between 0.5 and 2 cm, more preferably still, between 0.8 and 1.3 cm, for example equal to 1 cm, as described in greater detail later.

In its section 30 situated to the rear of the ribbed portion of shank 22, the shank 20 has a constant-diameter circular cross section.

At its periphery it is also equipped with a plurality of lugs 32 uniformly spaced by the pitch P.

In the particular example depicted, the shank 20 in reality comprises two diametrically opposed rows of identical or similar lugs 32, which lugs are aligned axially and uniformly spaced by the pitch P (in this instance three lugs in each row).

Between these two rows of lugs 32, the shank 20 also has two diametrically opposed grooves 34, each of them being straight and continuous as far as the rear end of the shank, and extending in the axial direction X1. Only one of these grooves 34 is visible in FIG. 4.

As illustrated in FIG. 4, the shank 20 also comprises a plurality of grooves 36 extending in the one same circumferential direction from each axial groove 34. These grooves 36 referred to as circumferential grooves in this instance extend over just part of the circumference of the shank 20. They are mutually parallel and spaced apart by the pitch P, and are axially offset from the aforementioned lugs 32 by a distance for example equal to P/2 (in the example, one lug is respectively axially centered between two circumferential grooves 36).

As illustrated in FIGS. 1, 2, 3A and 3B, the securing base 12 is equipped with an adjusting part 40 of tubular shape extending along an axis X3 and solidly attached to the means for securing to the structure that is to be lined, in this instance the securing mounting plate 14. The adjusting part 40 here forms a hollow tube designed to accept within it the shank 20, the axes X1 and X3 therefore being coincident. For that, it comprises a central open part 42 of circular internal cross section, of a diameter slightly greater than that of the shank 20, extended by two diametrically opposed housings 44*a*, 44*b* intended to accept the lugs 32 of the shank 20 in a first angular position.

Figure 1:
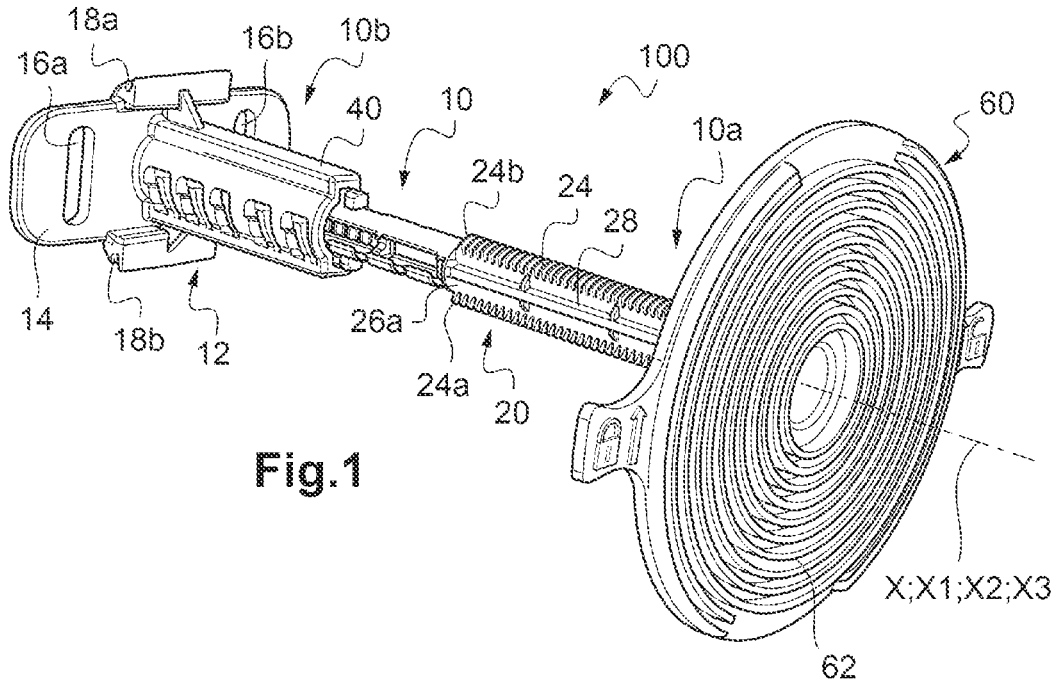
FIG. 1 illustrates a bracing device according to a first embodiment of the present invention, comprising a body formed of a base for securing it to the structure and of a shank, and a mounting plate, mounted on said shank, for securing a facing panel.

As illustrated in FIG. 1, the adjusting part 40 is equipped, on its central part 42, with a plurality of notches 46 which are aligned in the axial direction and spaced apart by the pitch P.

More specifically, the adjusting part 40 here comprises two diametrically opposed rows of five notches 46 each.

In the example, the notches 46 are open ended holes, so that the fitter can see the adjustment. However, in a variant, the notches 46 could be formed by non-penetrating recesses made on the internal wall of the adjusting part 40.

At the same time, the adjusting part 40 exhibits (see FIG. 3B), in the vicinity of its front end, two diametrically opposed internal additional thicknesses 41*a*, 41*b* dimensioned to each side in one of the axial grooves 34 of the shank 20 when the shank 20 and the adjusting part 40 are in the first angular position.

In the first position, the shank 20 is designed to slide axially in the adjusting part 40, so as to adjust the total length L of the body 10.

A relative rotation of the shank 20 and of the securing base 12 is permitted when each lug 32 of the shank 20 situated inside the adjusting part 40 is positioned axially facing a notch 46 of this same part 40, and at the same time each internal additional thickness 41*a*, 41*b* of the adjusting part 40 is positioned axially facing one of the circumferential grooves 36 of the shank 20. The corresponding positions are referred to hereinafter as positions of adjustment.

In these positions of adjustment, the shank 20 and the securing base 12 are able to pivot, in one direction of rotation, so as to cause the lugs 32 of the shank 20 to penetrate into the notches 46 of the adjusting part 40.

As illustrated in FIG. 4, the shank 20 preferably has an upper safety portion 38 that has no circumferential grooves 36. In the example illustrated in FIG. 1, the first circumferential groove 36 is situated between the second and the third lug 32, counting from the rear end 20*b* of the shank 20. Thus, the pivoting toward the second angular position is permitted only when at least the first two lugs 32 have penetrated the adjusting part 40. These arrangements avoid the fitter fitting the shank 20 onto an insufficient number of lugs 32 for reacting the compressive/tensile forces and possibly the bending forces to which the bracing device 100 is subjected in operation.

The securing base 12 and the shank 20 are held in position after the length L of the body 10 has been adjusted by virtue of means for blocking the rotation of the two elements in the second angular position.

These blocking means here comprise mechanical means with end stops and, more particularly, clip-fastening means, which will be described in greater detail later.

Figure 3A:
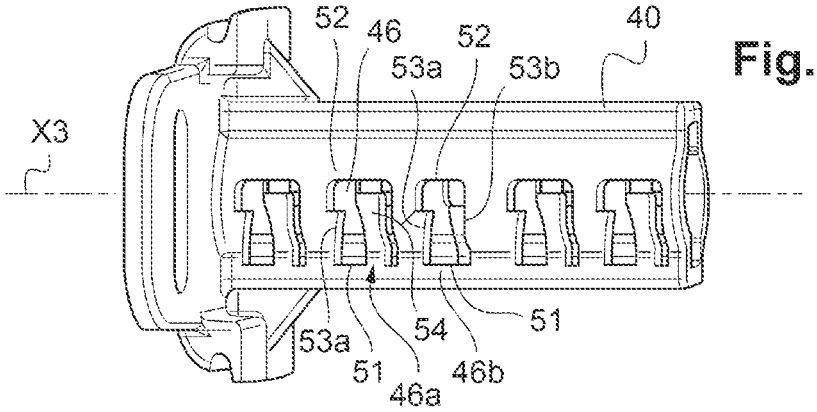
FIGS. 3A and 3B are detailed views of the base.

For the remainder of the present description, the notches that have a rotation blocking function are referred to as blocking notches 46*a*, and the notches that have exclusively a translation blocking function are referred to as intermediate notches 46*b* (see FIG. 3A).

In general, any notch 46 forms a housing extending in a circumferential direction and having, in that direction, a first end 51 via which a lug 32 of the shank 20 moving away from the first angular position enters the notch, and a second end 52 toward which that same lug 32 heads during the rotation from the first to the second angular position.

As illustrated in FIG. 3A, an intermediate notch 46*b* is generally delimited, in the axial direction, by two walls 53*a*, 53*b* orthogonal to the axis X2 and spaced apart by a distance equal to or very slightly greater than the length of a lug 32 measured in the axial direction.

Figure 3B:
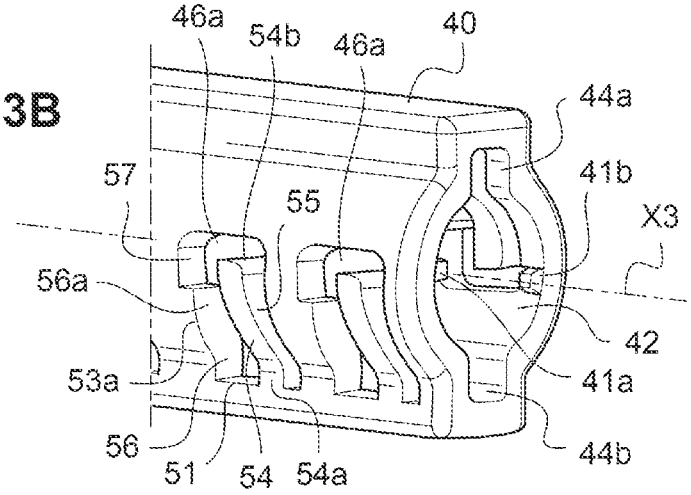

As illustrated in FIGS. 3A and 3B, a blocking notch 46*a* for its part is delimited by a fixed wall 53*a* and, in the example, by a clip-fastening tongue 54, which is secured by a proximal end 54*a* at the level of the first end 51 of the notch 46*a* and extends in a circumferential direction as far as its opposite distal end 54*b* at which it is free.

An empty space 55 situated on the opposite side of the tongue 54 to the notch allows the tongue to move toward said side under the pressure exerted by the lug 32 moved in the notch during a rotation from the first to the second angular position.

The tongue 54 furthermore has elasticity properties that allow it to return automatically to its initial position in which it forms a non-return end stop for the lug, once the second angular position has been reached.

As illustrated in FIG. 3B, the clip-fastening tongue 54 defines with the wall opposite an engagement portion comprising a progressive narrowing 56*a* of minimal width less than the length of a lug 32 measured in the axial direction.

Beyond this narrowing 56*a*, the engagement portion 56 is extended by a blocking portion 57 designed to receive the lug 32 once the second angular position has been reached.

In the example, the tongue 54 is configured in such a way that a return to the first angular position is possible under the effect of a relative rotational movement of the shank 20 and of the securing base 40, or of the combined effect of a relative translational and rotational movement of the shank 20 and of the securing base 40.

Advantageously, as illustrated in FIG. 1, only certain notches 46, generally those situated at the ends of the adjusting part 40, are equipped with clipping means. Thus, the force necessary for unclipping is not excessively great and the blocking is reversible. If the fitter makes a mistake in the adjusting of the length, he can, subsequently, undo the blocking easily and adjust the length again. The clip-fastening, through the noise that it makes, also allows the fitter to be sure that rotation is complete and that the shank is correctly fastened to the securing base.

The successive steps of a method for lining according to the invention will now be described in connection with FIGS. 6A to 6E.

FIG. 6A illustrates a masonry wall delimiting a room 90, and that is to be lined in order to improve the thermal insulation of said room. It will be noted that, while the embodiment example illustrated relates to a masonry wall, the invention is suitable for any type of wall (concrete, blockwork, bricks, wood, etc.).

Brackets, a bottom bracket 91 and a top bracket 92, are first of all secured, generally using screws, to the floor and to the ceiling of the room respectively, at a given distance from the wall M that is dependent on the thickness of the insulating filling G intended for the lining. L-shaped brackets are enough in this instance to secure the facing panels, but these could also be replaced by U-section rails of the kind used in the metal frameworks of the prior art.

Mid-way up the wall M a horizontal line 93 is drawn, marking the level at which the bracing devices 100 according to the invention are to be secured.

In a second step illustrated in FIG. 6B, the bodies 10 of the bracing devices are secured, in this instance by screwing their securing plates 14 directly to the wall M, at the level of the horizontal line 93 drawn previously.

The horizontal spacing between two bodies 10 is chosen to be short enough to ensure sufficient stiffness of the lining. This spacing might also be dependent on the width and mechanical performance of the facing panels.

Typically, 1 facing device is fitted per square meter, on average, and away from the special points.

In instances in which, as in the example illustrated, the length L of each body 10 is adjustable, this length will preferably be adjusted by the fitter beforehand, prior to securing the body to the wall M.

In a third step illustrated in FIG. 6C, a spacer filling G is interposed between the bodies 10 of the bracing devices. This filling G generally consists of one or more layer(s) of thermal and/or acoustic insulation, for example mineral wool, notably glass wool or rockwool. By way of alternative, widths of insulation may also be speared onto the projecting shanks of the bracing devices.

In addition, the lining may also comprise at least one damp-proof membrane fitted in front of the insulating filling. This damp-proof membrane may be speared onto the bodies of the bracing devices once the insulating filling has been fitted. In other instances, it may be integrated with said insulating filling (insulating panels covered on their front face with a damp-proof membrane).

In a fourth step illustrated in FIG. 6D, the mounting plates 60 of the bracing devices are mounted and secured on the shanks 20, thus partially covering the insulating filling G. Where appropriate, those parts of the shanks 20 that protrude from the mounting plate 60 after mounting are cut off, for example using a grinder or cutting pliers.

The alignment of the bearing faces 62 of the mounting plates 60 is verified using a level placed horizontally, resting against said bearing faces 62. For each bracing device 100, the axial position of the mounting plate 60 on its shank 20 can be adjusted, if necessary, using the quarter-turn system.

In the same way, the alignment of each bearing face 62 of each mounting plate 60 with the front face of the top and bottom brackets 91, 92 is checked using a level placed vertically, resting against the bearing face 62 of the mounting plate 60 on the one hand, and against, on the other hand, the front faces of the bottom bracket 91 and of the top bracket 92 respectively. Once again, an adjustment is made if necessary.

Figure 6F:
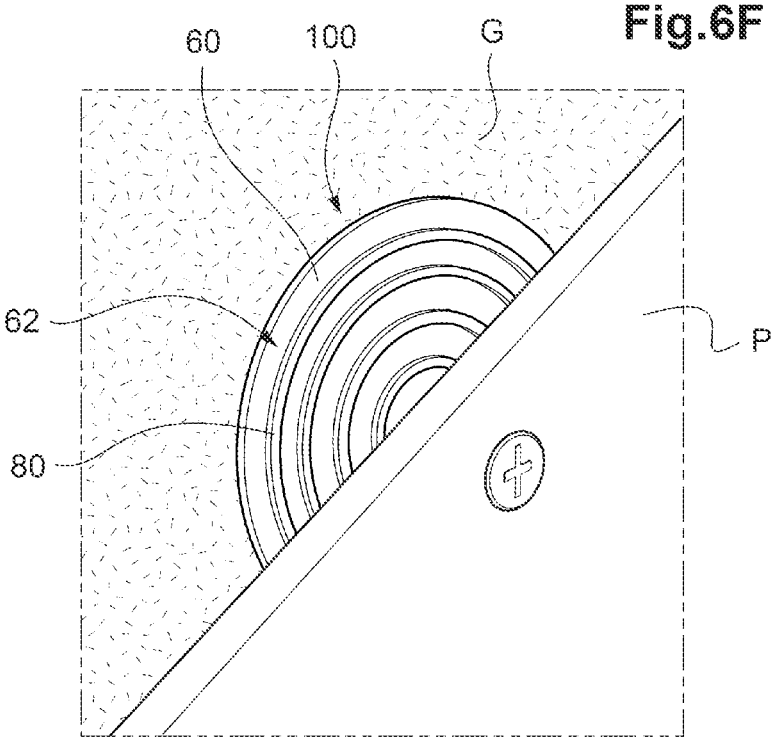

In a fourth step illustrated in FIGS. 6E and 6F, the facing panels P are pushed against the mounting plates 60 of the bracing devices 100 and then secured to said mounting plates.

In the example illustrated, the facing panels are secured to the mounting plates 60 using screws: the bracing devices being secured to the wall that is to be lined approximately mid-way up this wall and spaced from one another by a distance equivalent to half the width of a sheet, each sheet is secured by at least two fixing points: one fixing point at the center (which can easily be determined because it is mid-way from the lateral edge of the sheet) and one fixing point near each lateral edge (except when this edge adjoins an end of the wall that is to be lined and therefore rests against the adjacent wall).

As an alternative or in addition, the panels could also be secured by bonding, in particular using a liquid or pasty adhesive, for example as mastic, or by means of an adhesive element, of the film or tape type, in particular a double-sided sticky tape.

A bracing device 200 according to the invention may also be used to create a dividing partition, formed of a first and of a second facing which are parallel.

In that case, as illustrated in FIG. 7, the rear end 10*b* of the body 10 of the device 200 may be equipped with means for securing it to at least one panel P1 of the first facing and the mounting plate 60 of the device 200 is intended for securing a panel P2 of the second facing. Hereinafter, a primary panel is defined as being a panel belonging to the first facing of the partition and a secondary panel as being a panel belonging to the second facing.

The means for securing to the primary panel P1, which are present at the rear end 10*b* of the body 10, may take the form of a second mounting plate 160 similar to the one described hereinabove, or in other words a mounting plate equipped with a face that is planar overall for the primary panel P1 to bear against (and which is therefore oriented toward the rear of the device), said bearing face having at least one transverse dimension greater than or equal to 30 mm, preferably greater than or equal to 45 mm. Advantageously, the second mounting plate 160 is of one piece with the body 10. In the case illustrated in which the body comprises a shank 20 extending in the axial direction X, at its front end 10*a*, and a securing base 12, the second mounting plate 160 is of one piece with said securing base 12.

The structural features and dimensions described hereinabove in connection with the first mounting plate 60 apply in the same way to the second mounting plate 160. In particular, the minimum transverse dimension of the second mounting plate 160 is greater than or equal to 30 mm, preferably greater than or equal to 45 mm. It may moreover be textured, in particular provided with concentric or honeycomb ribs or grooves.

FIGS. 8A to 8D illustrate the creation of a dividing partition C using a device 200 according to this second embodiment example.

In a first step, a first primary panel P1 is attached to bottom and top brackets 91', 92' fastened to the floor and to the ceiling respectively.

Figure 8B:
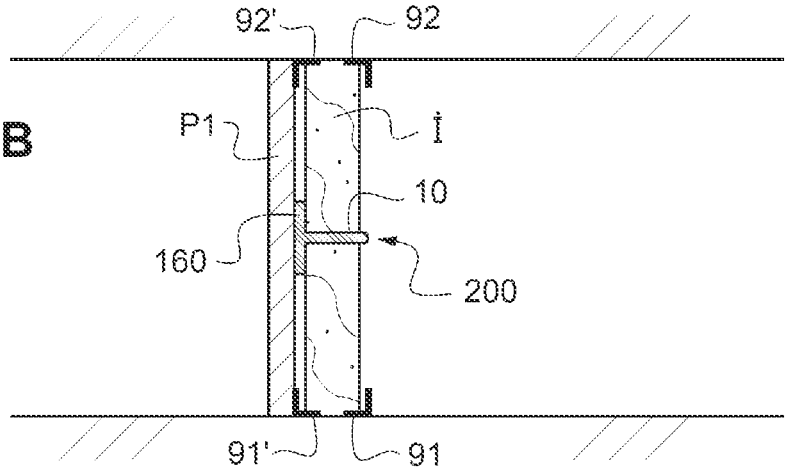

In a second step illustrated in FIG. 8B, the bracing device 200 is secured to that face of the first primary panel P1 that faces toward the inside of the partition, and therefore toward the second facing. To do that, the second mounting plate 160 is positioned with its bearing face against the face of the panel P1 and secured to that face, for example by screwing and/or by bonding.

Figure 8C:
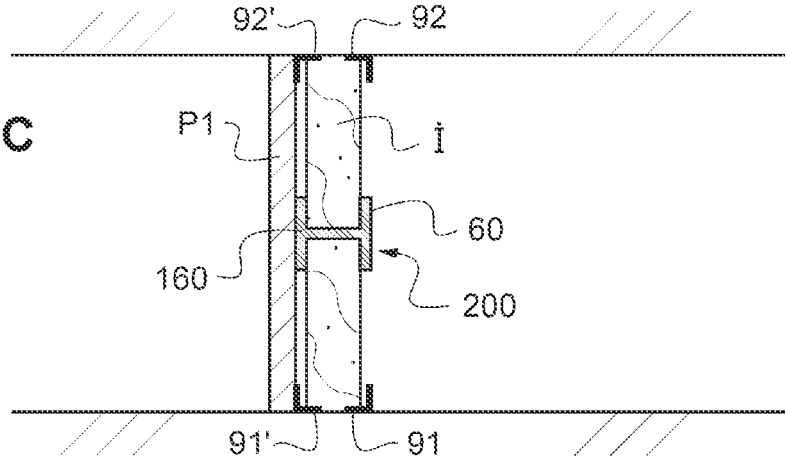
Figure 8D:
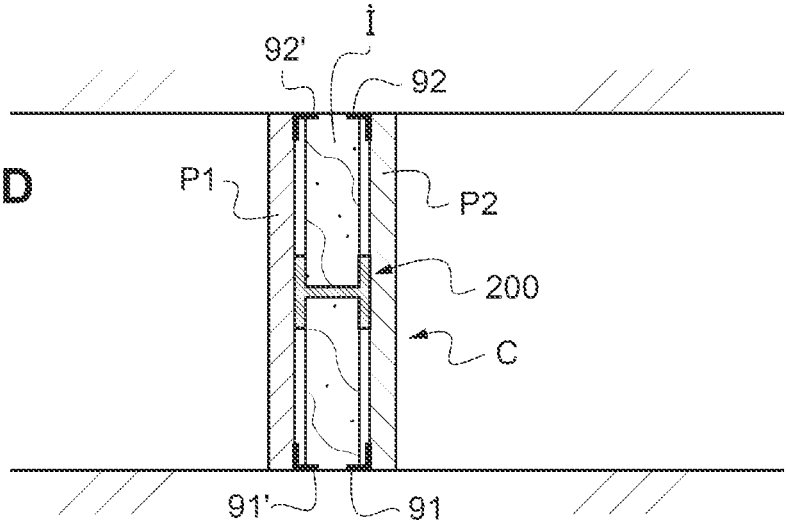

In a third step illustrated in FIG. 8C, the first mounting plate 60 of the device is engaged and adjusted for position on the body 10. Beforehand, a layer of insulation I, in particular a layer of fibrous insulation, in particular mineral wool, or a layer of animal or plant origin, may have been speared onto the shank of the device or inserted between several shanks of adjacent devices.

Then a secondary panel P2 is placed to bear directly on the first mounting plate 60 (FIG. 8D) and secured to the first mounting plate 60, for example by screwing and/or bonding, in the way described hereinabove in connection with FIG. 6F.

The invention claimed is:

1. A bracing device for securing at least one facing panel in front of a structure, the bracing device comprising:

a mounting plate equipped with a bearing face which is planar overall, against which the facing panel can bear, said bearing face having at least one transverse dimension greater than or equal to 30 mm, and a body extending in an axial direction and equipped, at a front end, with means for securing it to the mounting plate and, at a rear end opposite to the front end, with means for securing it to the structure, wherein the body at its front end comprises a shank extending in the axial direction, and the mounting plate is designed to be engaged on said shank via a mounting opening formed in said mounting plate, wherein the means for securing the mounting plate to the shank comprise primary ribs formed at a periphery of a portion of said shank and the mounting plate has at least one secondary rib projecting toward the inside of the mounting opening, the secondary rib being designed to collaborate with the primary ribs for blocking said mounting plate on the shank in terms of translation movement in the axial direction, and wherein the bracing device is adapted for having a layer of thermal and/or acoustic insulation speared onto the bracing device or interposed between a plurality of the bracing devices.

2. The device as claimed in claim 1, wherein a minimum transverse dimension of the mounting plate is greater than or equal to 30 mm.

3. The device as claimed in claim 1, wherein the bearing face is provided with catching means able to collaborate with means for securing of the facing panel.

4. The device as claimed in claim 1, wherein the bearing face is textured.

5. The device as claimed in claim 1, wherein the mounting plate comprises means for connection to a profile section.

6. The device as claimed in claim 1, wherein the mounting plate is designed to be removably secured to the body.

7. The device as claimed in claim 1, wherein the body comprises the shank extending in the axial direction, at its front end, a securing base bearing the means for securing to the structure, and a mechanism for adjusting the length of the body by intervals through relative sliding of the securing base and of the shank.

8. The device as claimed in claim 7, wherein the adjusting mechanism is configured in such a way that the securing base and the shank are designed to slide one relative to the other in the axial direction in a first relative angular position, and the securing base and the shank are designed to pivot into a second relative angular position in which the securing base and the shank are blocked from axial translation in a plurality of positions of adjustment spaced at intervals in the axial direction.

9. The device as claimed in claim 1, wherein the means for securing it to the structure comprise a second mounting plate equipped with a bearing face that is planar overall, having at least one transverse dimension greater than or equal to 30 mm.

10. The device as claimed in claim 1, wherein the at least one transverse dimension is greater than or equal to 45 mm.

11. The device as claimed in claim 1, wherein the mounting opening extends throughout a thickness of the mounting plate.

12. The device as claimed in claim 11, wherein the at least one secondary rib projects toward the inside of the mounting opening along only a portion of a periphery of an inside surface of the mounting opening.

13. An assembly comprising at least one bracing device as claimed in claim 1 at least one facing panel, bearing directly against the bearing face of the mounting plate of the bracing device and secured to said mounting plate.

14. The assembly as claimed in claim 13, wherein the facing panel is secured to the mounting plate using screws.

15. The assembly as claimed in claim 13, wherein the facing panel is secured to the mounting plate by bonding means.

16. The assembly as claimed in claim 13, further comprising a layer of thermal and/or acoustic insulation speared onto or interposed between the bracing devices.

17. A method for securing at least one facing panel on the front of a structure, comprising at least the following steps, in this order:

supplying a plurality of bracing devices as claimed in claim 1, securing the bodies of the bracing devices to the structure, via their rear ends, securing the mounting plates on the bodies of the bracing devices, at their front ends, mounting at least one facing panel bearing directly against at least one mounting plate, and securing the facing panel to said at least one mounting plate.

18. The method as claimed in claim 17, wherein the facing panel is secured to the mounting plate by screwing.

19. The method as claimed in claim 17, wherein the facing panel is secured to the mounting plate by bonding.

20. The method as claimed in claim 17, wherein a layer of thermal and/or acoustic insulation is speared onto the bracing devices, or wherein a layer of thermal and/or acoustic insulation is interposed between the bracing devices.

* * * * *